US005986396A

United States Patent [19]

Verbunt et al.

[11] Patent Number: 5,986,396

[45] Date of Patent: Nov. 16, 1999

[54] DEFLECTION UNIT WITH RIGIDLY COUPLED YOKE RING AND COIL SUPPORT

[75] Inventors: Johannes P. M. Verbunt; Jozef E. M. Vael; Jan W. Aarts, all of Eindhoven, Netherlands

[73] Assignee: U.S. Philips Corporation, New York, N.Y.

[21] Appl. No.: 08/986,556

[22] Filed: Dec. 8, 1997

[30] Foreign Application Priority Data

Dec. 13, 1996 [EP] European Pat. Off. ..... 96203535

[51] Int. Cl.[6] ..... H01J 29/70; H01J 29/02; H01F 7/02

[52] U.S. Cl. ..... 313/440; 335/210; 313/402

[58] Field of Search ..... 313/402, 440, 313/407; 335/210, 217, 211, 213

[56] References Cited

U.S. PATENT DOCUMENTS 4,673,906 6/1987 Petrow ..... 335/210
5,138,290 8/1992 Togane et al. ..... 335/210
5,412,276 5/1995 Van Mensvoort ..... 313/402

FOREIGN PATENT DOCUMENTS

0624895A1 11/1994 European Pat. Off. ..... H01J 29/82
WO9708728 3/1997 WIPO ..... H01J 9/236

*Primary Examiner*—Vip Patel
*Assistant Examiner*—Joseph Williams
*Attorney, Agent, or Firm*—Robert J. Kraus

[57] ABSTRACT

Deflection unit for a display tube, comprising a coil support (8) with a saddle-type field deflection coil (12) and a yoke ring (14) surrounding this coil. A form-filling adhesive material (extending between the open portions of the field deflection coil as far as the support) is provided in the free space between the support (8) and the yoke ring (14), with which material the support and the field deflection coil are rigidly connected to the inner surface of the yoke ring. Vibrations of the yoke ring, and noise generated by the coil support due to transmission of these vibrations to the support, are substantially prevented, particularly if the adhesive material also has a damping effect, or if a thin layer of visco-elastic material preferably realizing a detachable connection between the adhesive material and the yoke ring is provided between this adhesive material and the yoke ring.

8 Claims, 4 Drawing Sheets

DEFLECTION UNIT WITH RIGIDLY COUPLED YOKE RING AND COIL SUPPORT

BACKGROUND OF THE INVENTION

The invention relates to a deflection unit for a display tube, which deflection unit comprises a hollow support with a field deflection coil and a yoke ring surrounding said coil.

Such a deflection unit may be used in display tubes for monochrome, color and projection television, data display apparatus and other apparatuses in which a cathode ray tube is used.

Upon energization, the deflection unit deflects electron beams generated in the display tube for forming an image on the display screen of the display tube.

As is known from U.S. Pat. No. 5,412,276, a unit of this type is generally constructed in such a way that the two coils are mounted on a hollow synthetic material support (one on the inner side and one on the outer side) and that the yoke ring surrounds these coils and is fixed because it is secured to the support by means of an adhesive which is present at the base of the yoke ring.

A problem occurring in the known deflection units is that, in operation, these units sometimes produce much noise.

SUMMARY OF THE INVENTION

It is an object of the invention to provide a deflection unit in which the occurrence of unwanted noise during use in a cathode ray tube for displaying images is at least substantially prevented.

According to the invention, a display tube of the type described in the opening paragraph is therefore characterized in that the space between the support with the field deflection coil and the yoke ring is filled with a damping and/or rigidity-enhancing mass which couples the support with the field deflection coil to the inner surface of the yoke ring in a mechanically rigid manner.

The invention is based on the recognition that the occurrence of unwanted noise is principally caused by the fact that the electromagnetic fields which are generated when the deflection unit is energized cause the field deflection coil, which is secured to the outer side of the coil support in the conventional constructions, and the yoke ring to vibrate in an unwanted manner. These vibrations are passed on to the coil support which radiates these vibrations as noise ("acoustic radiator"). By coupling (securing) the field deflection coil and the coil support to the yoke ring in a mechanically rigid manner according to the invention, the overall vibration amplitude is reduced and the unwanted production of noise can be substantially prevented.

Suitable materials for the rigid connection are particularly a (form-filling) electrically insulating synthetic material such as epoxy material, polyurethane material, or polypropylene material (advantage: possibility of recycling), but also materials such as plaster or concrete are alternatively usable.

There is a mechanically rigid coupling, particularly when at least 90% of the free volume (volume not occupied by the field deflection coil and possible correction means) between the support and the yoke ring is filled up with a filling mass in such a way that (after curing) the filling mass sticks to the support and the yoke ring and the field deflection coil is "cast in", as it were. An improvement from 28 dB to 15 dB is achieved (the unfilled state compared with the filled state, measured at a peak-peak measuring current of 2 A).

In a preferred embodiment, the space between the coil system and the yoke ring is filled up with a rigidity-enhancing adhesive which has also a damping effect. There are certain synthetic materials which provide both the mechanically rigid connection and have some damping effect. Only a rigid coupling between the yoke ring and the support could increase the resonance of the yoke ring. A damping effect prevents too strong resonances.

In another preferred embodiment, there are two layers between the coil support with the deflection coil and the yoke ring: a filling layer of a rigid connection material and a layer of a visco-elastic material between this layer and the yoke ring. The layer of visco-elastic material functions as a dynamically hard coupling medium. It is preferably an adhesive which detachably connects the coil system to the yoke ring. An extra advantage of using such a medium is that the yoke ring can be detached from the rest of the deflection unit. A better recycling of a deflection unit is then possible, which is environmentally beneficial. The adhesive may be present on the inner side of the yoke ring before the filling layer is provided.

In a further embodiment of the invention, the field deflection coil is incorporated in the filling layer. In that case, the filling layer may also serve as a support for the line deflection coil. This coil may be separately secured to this layer or it may be incorporated in this layer, likewise as the field deflection coil. In both cases, a separate synthetic material coil support is no longer necessary. The filling layer is then self-supporting. Polypropylene is a suitable material for this purpose because it can be recycled.

The invention also takes the line that the area where the forces on the field deflection coil are greatest during use is the space between the coil and the yoke ring. Due to the interactive forces between the coil and the yoke ring, the coil and the yoke ring move towards and away from each other and the yoke ring may start resonating. The coil is mechanically "weak" and does not have any resonances.

These resonances may be combated by rigidly coupling the components of the system together by filling the free space with a filling mass. Addition of a mass may already modify the resonance of the system.

These and other aspects of the invention are apparent from and will be elucidated with reference to the embodiments described hereinafter.

DESCRIPTION OF THE PREFERRED EMBODIMENTS

Figure 1:
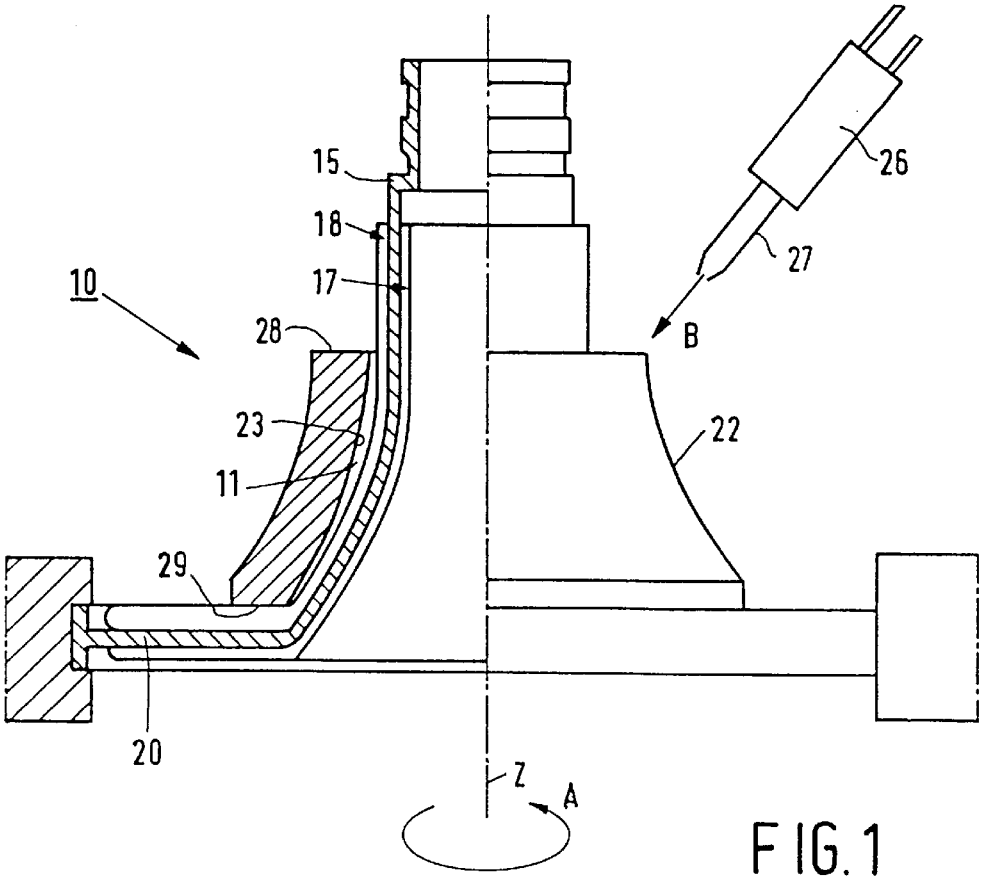
FIG. 1 shows a deflection unit according to the invention in a partial longitudinal section and in a partial elevational view.
Figure 2:
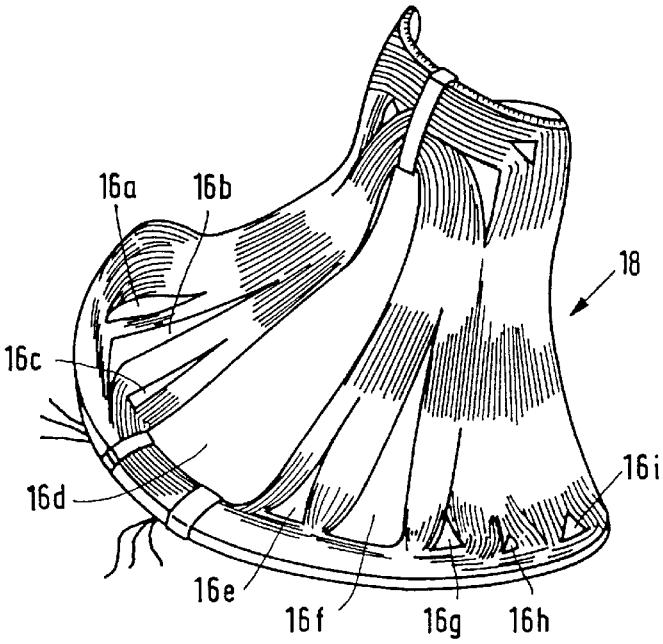
FIG. 2 is a perspective elevational view of (half) a field deflection coil.

FIG. 1 shows a deflection unit 10. This deflection unit 10 has a coil support 15 of an electrically insulating material with a front end 20. The inner side of the support 15 is provided with a line deflection coil 17 for generating a (line) deflection field for deflection in the horizontal direction of electron beams produced by an electron gun system in a display tube on which the deflection unit is mounted, and the outer side of the support 15 is provided with a field deflection coil 18 for generating a (field) deflection field in the vertical direction. In this case, the deflection coils 17 and 18 are surrounded by a yoke ring 22 of a sintered ferromagnetic material having a front end face 29 and a rear end face 28. In the relevant case, the field deflection coil 18, one half of which is shown separately in FIG. 2, and the line deflection coil are of the saddle type. In this embodiment, the field deflection coil 18 is of the type having an upstanding (widest) front end and a lying (narrowest) rear end which, compared with the type having an upstanding rear end, makes it easier to administer an adhesive. The adhesive may be administered by means of, for example a pump 26 and a nozzle 27, as indicated by the arrow B, while rotating the deflection unit, as indicated by the arrow A.

In this embodiment, the support 15 with the field deflection coil 18 is rigidly secured to the inner surface 23 of the yoke ring 22 by means of a form-filling material 11. The material is preferably an insulating material so as to prevent short-circuit between parts of the field deflection coil.

It is essential that not only the field deflection coil 18 but also the coil support 15 is rigidly connected ("hard-coupled") to the yoke ring 22. To this end, the filling agent should also extend between the open parts 16*a* . . . 16*i* of the field deflection coil as far as the coil support (particularly the coil window should be filled as much as possible). When a filling agent is used which itself has hardly any or no damping effect, resonances may occur. The use of a thin (5 to 100 $\mu$m) layer of visco-elastic material on the inner side of the yoke ring may prevent too strong resonances.

For example, silicon grease (in a thickness of several dozen micrometers) has been found suitable for this purpose. When the deflection unit is being manufactured, for example, the field deflection coil may be cast in a mould formed by a greased yoke ring. In another method, the field deflection coil is first cast in a synthetic material in such a form that it exactly fits within the yoke ring. A thin layer of the silicon grease is present between the cast-in field deflection coil and the yoke ring subsequently provided around the coil.

In the deflection unit, electromagnetic forces bring about a periodical attraction between the field deflection coil and the yoke ring. By providing the thin layer of silicon grease, the mechanism of motion is strongly damped. The compressive stress caused in the silicon grease by this mechanism of motion, for example, due to an increase of the current through the field deflection coil is converted into "squeeze". Moreover, a shearing stress between the field deflection coil and the yoke ring is produced. When the attractive force between the field deflection coil and the yoke ring is eliminated (due to a decrease of the current through the field deflection coil), the silicon grease slows down the inverse motion.

When using silicon grease, the fixation is such that it can be broken by using the required force. This is an advantage when the product incorporating the deflection unit is discarded. Then, the deflection unit is not chemical waste as a whole (an object of approximately 1 kg) but it can be dismantled. The yoke ring can be removed. Since this is a heavy part and processing of chemical waste must be paid for per kg, this yields a large financial saving. The silicon grease is thermally stable so that it does not burn, melt or fall apart in a deflection unit which has become hot during operation.

The yoke ring would often be connected with its front end to the coil support by means of an adhesive material. Subsequently, an adhesive material could be injected into the space between the yoke ring and the field deflection coil, filling up this space. However, the invention provides a particularly practical alternative method in which the yoke ring is provided with silicon grease before injecting the adhesive material into the space. This renders the fixation to the base superfluous because the silicon grease realizes the adhesion.

It is a further idea to cast the field deflection coil in polypropylene so that the coil support can be omitted. This operation would have to be carried out in a mould. The silicon grease can then be provided either on the cast-in coil or on the yoke ring, whereafter the two are joined.

Another idea is to cast the field deflection coil in an adhesive material which is also noise-damping, so that the grease is no longer necessary. This could be realized with a group of materials used in sandwich constructions. These are visco-elastic materials constituting a constraining layer between two layers of another material, for example a metal.

Experiments have proved that the deflection unit produces less noise when the volume between the yoke ring and the field deflection coil, or the coil support is filled with a "hard" casting mass (epoxy, PUR). This is because the support with the field deflection coil is coupled to the yoke ring by the casting mass with which it constitutes a mechanical unit. Excitation by Lorentz forces (the cause of the noise radiated by the deflection unit) of this mechanical unit is less efficient and, for this reason, a reduction of noise is obtained.

Figure 3:
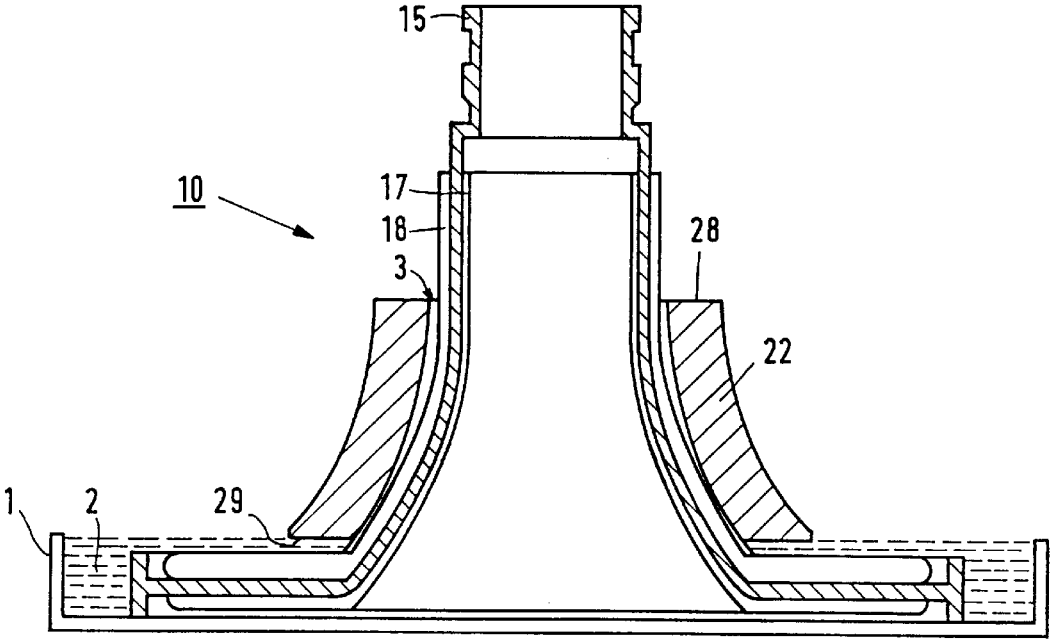
FIG. 3 is a diagrammatic cross-section of a deflection unit which is placed in a water-filled vessel during the provision of an adhesive.
Figure 4:
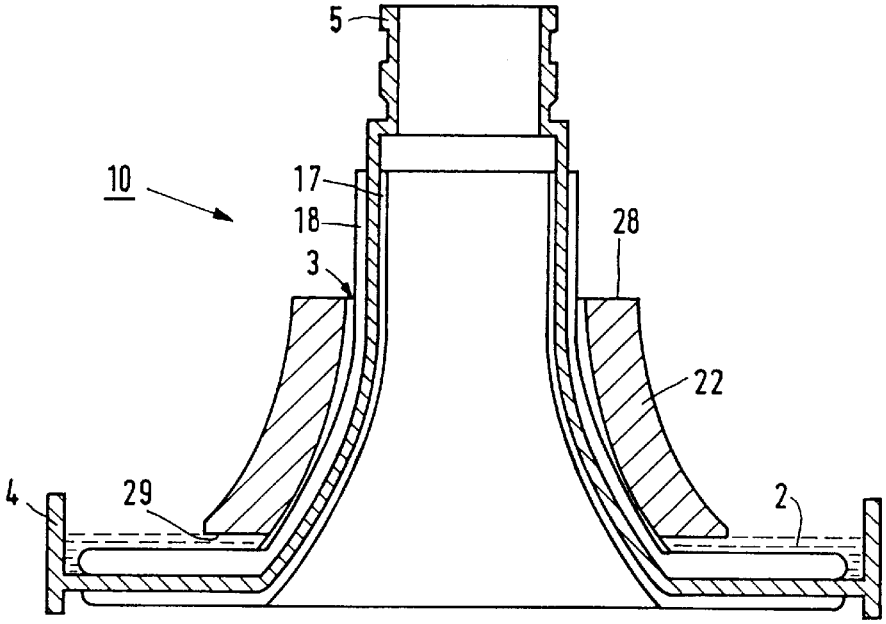
FIG. 4 is a diagrammatic cross-section of a deflection unit which is filled with water between raised edges of its coil support during the provision of an adhesive.

A problem is how to fill this volume without the casting mass flowing away: the method described hereinafter with reference to FIGS. 3 and 4 provides a solution to this problem.

The deflection unit 10 "to be filled" via a filling aperture 3 is placed in a vessel 1 which is filled with a liquid 2 to such an extent that the liquid level reaches the lower rim 29 of the yoke ring 22 in a sufficient manner (FIG. 3). In coil supports provided with peripheral raised edges 4 ("basin"), the vessel may be dispensed with and the "basin" is filled up to the correct height with liquid 2 (FIG. 4). Subsequently, a casting mass having a specific resistance<1 is cast at the upper side of the yoke ring 22 between the yoke ring 22 and the coil support 15 until it reaches the height of the rear face 28 of the yoke ring. Since the casting mass has a specific weight of<1, it will float on water. After curing, the unit is removed from the water (or the water is poured off) and only the volume which was to be filled with a casting mass is fully filled up. The curing process can be accelerated by heating the water. This method is attractive because it can be used for any combination of support, yoke and ring. Moreover, the method yields a large saving of the quantity of casting mass. In the "basin method", the "basin" is usually filled up so as to ensure that the casting mass establishes the connection between the support and the yoke ring after curing. According to the invention, the space between the support and the yoke ring is filled up as completely as possible, with which also the desired connection is obtained, while the use of a "basin" with a casting mass at the base is superfluous. An additional advantage is a reduction of weight (a large weight leads to breakage in the neck of the display tube).

In this way, a deflection unit can be manufactured in a simple and economic way with a yoke ring having a (widest)

front end face and a (narrowest) rear end face which is characterized in that the filling mass fills up more than 90% and particularly more than 95% of the space between the support with the coil and the yoke ring present between the end faces.

The water level regulation can be utilized for regulating the level of the casting mass and for compensating its weight, if necessary. In fact, the weight of the casting mass is equal to the weight of the displaced quantity of water. A possibility of rendering the specific weight of the casting mass<1 is to use glass bubbles as a filling material. These are air-filled glass bubbles having a diameter of 50–100 microns.

If a casting mass having a low viscosity is to be used, for example, for the purpose of reaching all cavities and gaps satisfactorily, the method may be performed in two steps. The first step is to provide a liquid stop at the end of the ring, for example by providing a (for example, glass-filled) epoxy for forming a thin (synthetic material) membrane. The next step is to cure, which can be done rapidly in hot water (small mass). It is even possible to do this on a yoke alignment apparatus. During alignment of the yoke ring, "sealing" takes place. In a subsequent process step, the space between the coil support and the yoke ring is filled up with a desired casting mass having a low viscosity.

There is a risk that, due to its porosity, the yoke ring takes up water as soon as the water reaches its lower rim so that a good adhesion (sealing) of the casting mass is not possible. This can be prevented by providing a small height (3 mm) of the lower rim of the yoke ring with an agent which inhibits absorption of water but enhances the adhesion of the casting mass.

In a first series of experiments, an epoxy mixture of the trademark mentioned below was used, which was mixed with glass bubbles in the following mixing ratio:

Epoxy: Polypox THV 500
Hardener: Polypox Hardener 455
Glass bubbles: Filling material
Volume ratio: 2:1:2

Alternatively, the liquid stop (or barrier) provided at the end within the yoke ring may be, for example a rubber gasket, a gel or the like, provided that it renders it possible to cast in a liquid (of low viscosity) without this liquid substantially flowing out at the lower side of the yoke ring. If the casting mass can flow out at the lower side, it is not very well possible to satisfactorily fill the space between the support and the yoke ring. In that case, it is questionable whether a rigid coupling as described hereinbefore can be achieved.

The reduction of noise in deflection units by means of a field deflection coil which is rigidly connected to the yoke ring is alternatively possible by pairing resonances of the mechanical system with minimal values of the excitation of force as a result of the current flowing through the field deflection coil.

Mechanisms which are responsible for the noise made by a deflection unit are caused by the current flowing through the field deflection coil. This sawtooth current has a repetition frequency of 50 Hz or 100 Hz in TV and a maximum value of 160 Hz in monitors. The relatively short retrace time (0.3–0.6 ms) causes the excitation of force (Lorentz forces) to have many higher harmonics.

Figure 5:
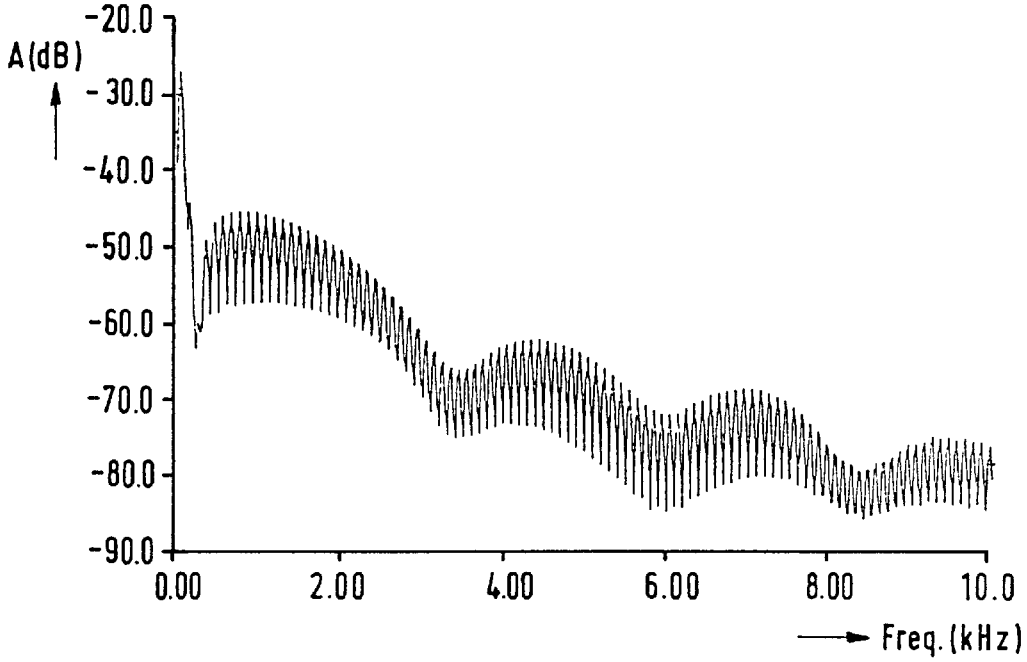
FIGS. 5 and 6 show frequency spectra which are representative of sawtooth-shaped currents through the field deflection coil of a deflection unit with a retrace time of 0.4 msec and 0.53 msec, respectively.
Figure 6:
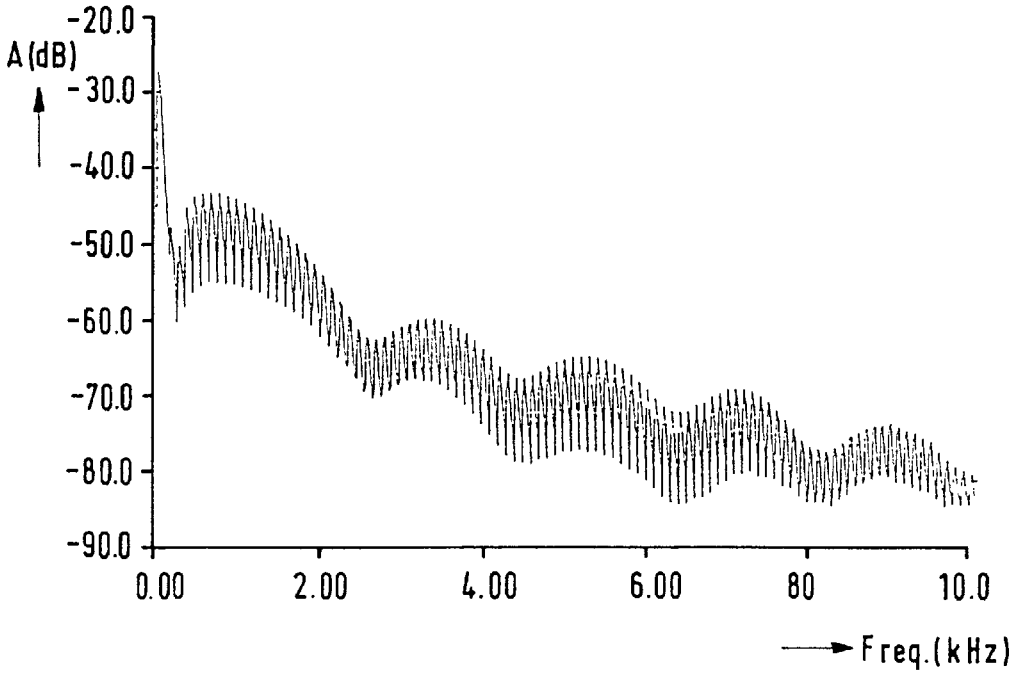

Since the excitation of force is periodical (time domain), the amplitude spectrum of the force (frequency domain) is a line spectrum whose envelope has a lobe structure. Since the force A is a quadratic function of the current (electromagnetical property), the excitation of force would be characterized by a double frequency in the case of a sinusoidal current. However, due to the sawtooth shape of the current (asymmetrical), the excitation of force has the same fundamental frequency, as can be seen in the frequency spectrum (FIG. 5). The first lobe has the largest energy content, while in the subsequent lobes the amplitude of the harmonics and hence the energy contents decrease. The precise coherence between the time-variation of forces and the spectrum of forces can be computed by means of a Fourier transformation. If the retrace time of the sawtooth current is changed, the lobe structure also changes. This is shown for two different retrace times, 0.4 ms (FIG. 5) and 0.53 ms (FIG. 6).

If a deflection unit is considered as a mechanical system having a number of natural frequencies, and if the most dominant natural frequency of this system is caused to coincide with one of the frequencies at which a "dip" occurs in the spectrum of forces, then a maximal noise reduction is achievable. This is improved as the mechanical system is more coherent, ie when the components (field deflection coil, yoke ring, coil support, etc.) are "more closely" connected together. In this case, a deflection unit according to the invention is characterized in that it is connected to means for passing a sawtooth-shaped current through the field deflection coil and has a most dominant natural frequency which is remote from the maximum values in the spectrum of forces generated by the sawtooth-shaped current (and preferably proximate to a minimum value thereof). This can be realized by matching the retrace time of the sawtooth-shaped current.

Figure 7:
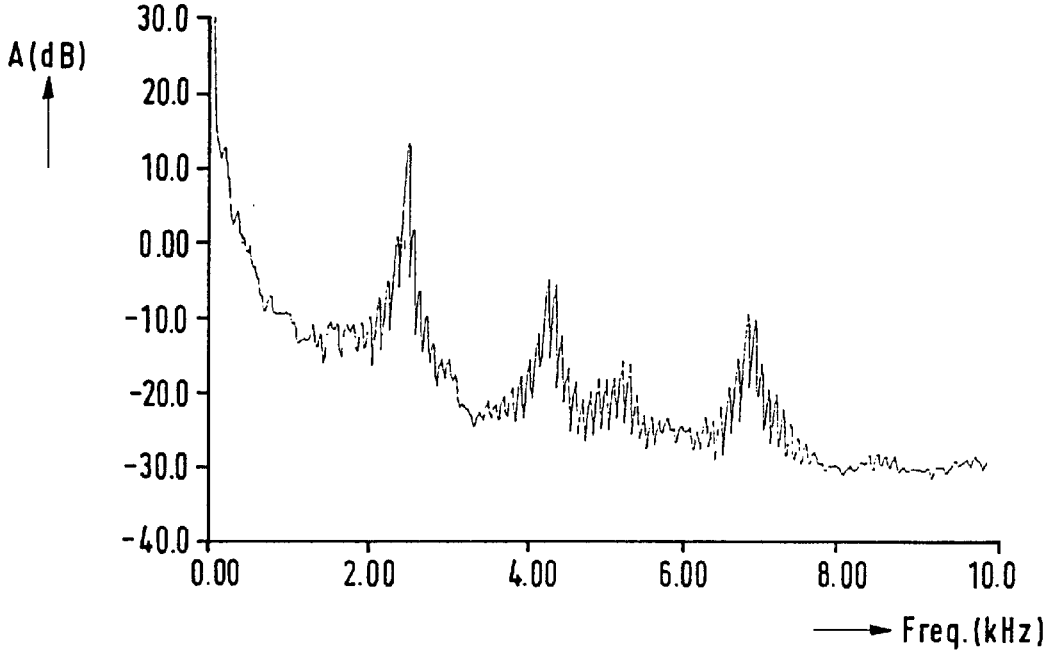
FIGS. 7 and 8 show graphs showing the noise pressure of a field deflection coil and yoke ring cast in epoxy as a function of the frequency at a retrace time of 0.4 msec and 0.53 msec, respectively.
Figure 8:
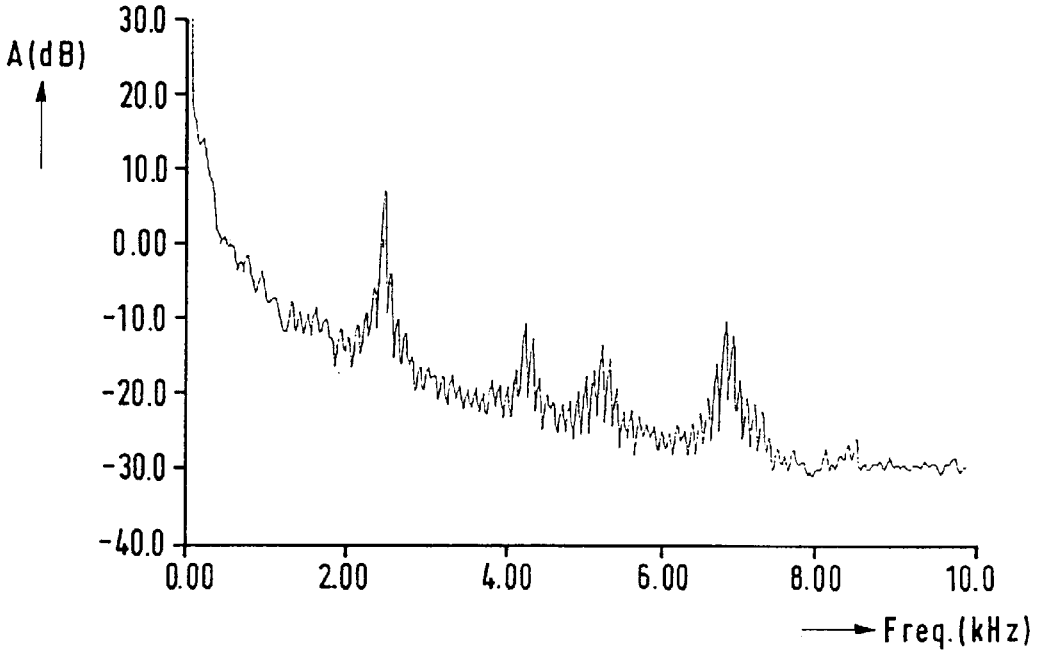

An experiment was performed on a combination of a field deflection coil and a yoke ring for which this principle was used. The first natural frequency of this combination is 2.5 kHz. The amplitude of the sawtooth-shaped current was 1.22 A peak-peak and the frequency was 100 Hz. FIGS. 7 and 8 show the narrow-band noise spectra which were measured at a retrace time of 0.40 ms and 0.53 ms, respectively. At a retrace time of 0.53 ms, a minimum value of the spectrum of forces (the minimum value between the first and the second lobe) corresponds to the dominant natural frequency of the mechanical system.

The noise reduction achieved thereby is 3 dB(A). Instead of matching the retrace time to the natural frequency of the deflection unit, the natural frequency of the deflection unit may be matched to the retrace time (for example, by adapting the mass of the yoke ring).

In summary, the invention relates to a deflection unit for a display tube, which deflection unit comprises a coil support with a saddle-type field deflection coil and a yoke ring surrounding this coil. A form-filling adhesive material (extending between the open portions of the field deflection coil as far as the support) is provided in the free space between the support and the yoke ring, with which material the support and the field deflection coil are rigidly connected to the inner surface of the yoke ring. Vibrations of the yoke ring, and noise generated by the coil support due to transmission of these vibrations to the support, are substantially prevented, particularly if the adhesive material also has a damping effect, or if a thin layer of visco-elastic material preferably realizing a detachable connection between the adhesive material and the yoke ring is provided between this adhesive material and the yoke ring.

We claim:

1. A deflection unit for a display tube, which deflection unit comprises a hollow support with a field deflection coil and a yoke ring surrounding said coil, characterized in that a space between the support with the field deflection coil and the yoke ring is filled with a damping and rigidity-enhancing filling agent which secures the support and the field deflection coil to an inner surface of the yoke ring in a mechanically rigid manner.

2. A deflection unit as claimed in claim 1, characterized in that the filling agent is a polypropylene material.

3. A deflection unit as claimed in claim 1, characterized in that the field deflection coil is cast in a filling agent which also constitutes the support.

4. A deflection unit for a display tube, which deflection unit comprises a hollow support with a field deflection coil and a yoke ring surrounding said coil, said yoke ring having a front end face and a rear end face, characterized in that a damping and rigidity-enhancing filling fills more than 90% of a space between the support with the field deflection coil and the yoke ring which is present between the end faces and thereby secures the support and the field deflection coil to the yoke ring.

5. A deflection unit as claimed in claim 1, characterized in that the filling agent comprises a first layer, adjoining the support, of a rigid connection material and a second layer, adjoining the yoke ring, of a visco-elastic material.

6. A deflection unit as claimed in claim 5, characterized in that the visco-elastic material is silicon grease.

7. A deflection unit as claimed in claim 4, characterized in that a liquid stop sealing the yoke ring on its inner side is provided proximate to one of the end faces of the yoke ring.

8. A deflection unit as claimed in claim 1, characterized in that the deflection unit is connected to means for passing a sawtooth-shaped current through the field deflection coil, and the deflection unit has a most dominant natural frequency which is remote from maximum values in a spectrum of forces generated by the sawtooth-shaped current.

* * * * *